US007690502B2

(12) United States Patent
Cuomo

(10) Patent No.: US 7,690,502 B2
(45) Date of Patent: Apr. 6, 2010

(54) CARRIER AND METHOD

(75) Inventor: Angelo V. Cuomo, Staten Island, NY (US)

(73) Assignee: SJV Food & Beverage Carriers, Inc., Clark, NJ (US)

( * ) Notice: Subject to any disclaimer, the term of this patent is extended or adjusted under 35 U.S.C. 154(b) by 225 days.

(21) Appl. No.: 11/443,962

(22) Filed: May 30, 2006

(65) Prior Publication Data

US 2007/0199836 A1 Aug. 30, 2007

Related U.S. Application Data

(63) Continuation-in-part of application No. 11/345,898, filed on Feb. 2, 2006, and a continuation-in-part of application No. 11/301,407, filed on Dec. 13, 2005, now Pat. No. 7,438,181, and a continuation-in-part of application No. 11/301,913, filed on Dec. 13, 2005, now Pat. No. 7,475,772, and a continuation-in-part of application No. 11/012,440, filed on Dec. 15, 2004, now Pat. No. 7,383,949, and a continuation-in-part of application No. 11/012,789, filed on Dec. 15, 2004, now Pat. No. 7,370,755, and a continuation-in-part of application No. 10/939,264, filed on Sep. 10, 2004, now Pat. No. 7,604,115, and a continuation-in-part of application No. 10/737,612, filed on Dec. 16, 2003, now Pat. No. 7,267,224, and a continuation-in-part of application No. 10/662,265, filed on Sep. 15, 2003, now Pat. No. 7,243,785, and a continuation-in-part of application No. 10/215,938, filed on Aug. 9, 2002, now Pat. No. 7,185,758.

(51) Int. Cl.
*B65D 75/00* (2006.01)

(52) U.S. Cl. ..... 206/162; 206/168; 206/175; 206/180

(58) Field of Classification Search ..... 206/162, 206/168, 169, 170, 174, 175, 180, 183, 185, 206/186, 188; 229/117
See application file for complete search history.

(56) References Cited

U.S. PATENT DOCUMENTS

| | | | | |
|---|---|---|---|---|
| 2,011,232 | A | 8/1935 | Parks | |
| 2,026,525 | A | 1/1936 | Korte | |
| 2,182,065 | A * | 12/1939 | Warren | 206/142 |
| 2,217,028 | A * | 10/1940 | Powell | 206/169 |
| 2,268,209 | A * | 12/1941 | Ford et al. | 206/168 |
| 2,330,699 | A | 9/1943 | Flamm | |
| 2,405,517 | A | 8/1946 | Plummer | |
| 2,513,079 | A | 6/1950 | Buerger | |
| 2,594,376 | A | 4/1952 | Arneson | |
| 2,630,264 | A | 4/1953 | Holy | |
| 2,785,846 | A * | 3/1957 | Weiner | 229/117.15 |

(Continued)

*Primary Examiner*—Jila M Mohandesi
*Assistant Examiner*—Sharon M Prange
(74) *Attorney, Agent, or Firm*—Gregor N. Neff, Esq.

(57) ABSTRACT

The carrier has a central vertical support panel structure with two foldable receptacles extending outwardly from the vertical support panel structure. The outside wall of each receptacle is extended upwardly and bent over to cover the receptacle, and the top portions of those walls are joined together to form a carrying handle structure, either with or without the upper portion of the vertical support panel structure. The potions of the outside walls forming the covers can have openings to receive the necks of bottles such as wine and beer bottles to give added lateral support for the bottles.

18 Claims, 5 Drawing Sheets

U.S. PATENT DOCUMENTS 2,808,177 A * 10/1957 Buttery ..... 206/175
2,850,223 A 8/1958 Strauss
3,016,133 A * 1/1962 Jones ..... 206/229
3,123,213 A 3/1964 Kulig
3,140,036 A 7/1964 Spery
3,158,286 A 11/1964 Phillips, Jr.
3,204,814 A * 9/1965 Mahon ..... 206/162
3,576,274 A 4/1971 Stramaglis
3,661,417 A 5/1972 Inman
3,684,153 A * 8/1972 Detzel ..... 206/199
3,780,906 A 12/1973 Katzenmeyer
3,827,550 A * 8/1974 Arneson ..... 206/181
3,958,744 A 5/1976 Herglotz
4,354,630 A * 10/1982 Roccaforte ..... 229/117
4,378,880 A 4/1983 Summers
4,610,349 A 9/1986 Schwartz et al.
4,620,664 A 11/1986 Kaufman et al.
4,645,072 A * 2/1987 Lemon ..... 206/199
4,767,051 A 8/1988 Single
4,770,294 A 9/1988 Graser
4,836,367 A 6/1989 Golkar
4,969,595 A 11/1990 Teasdale
5,052,552 A 10/1991 Maroszek
5,320,216 A 6/1994 Pangborn
5,337,947 A 8/1994 Eskandry
5,400,901 A * 3/1995 Harrelson ..... 206/143
D367,409 S 2/1996 Hunter
5,595,291 A * 1/1997 Negelen ..... 206/143
5,695,051 A 12/1997 Hart
5,709,298 A 1/1998 Harris
5,797,486 A 8/1998 Picciolo
5,803,264 A 9/1998 Gersten et al.
5,833,056 A * 11/1998 Goldman ..... 206/199
5,927,502 A 7/1999 Hunter
6,202,836 B1 3/2001 Picciolo
6,341,689 B1 1/2002 Jones
6,443,308 B1 9/2002 Davis
6,736,260 B2 * 5/2004 Gomes et al. ..... 206/175

* cited by examiner

Fig.17
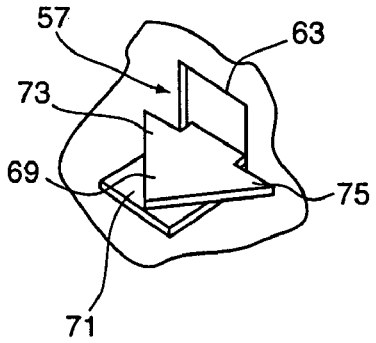
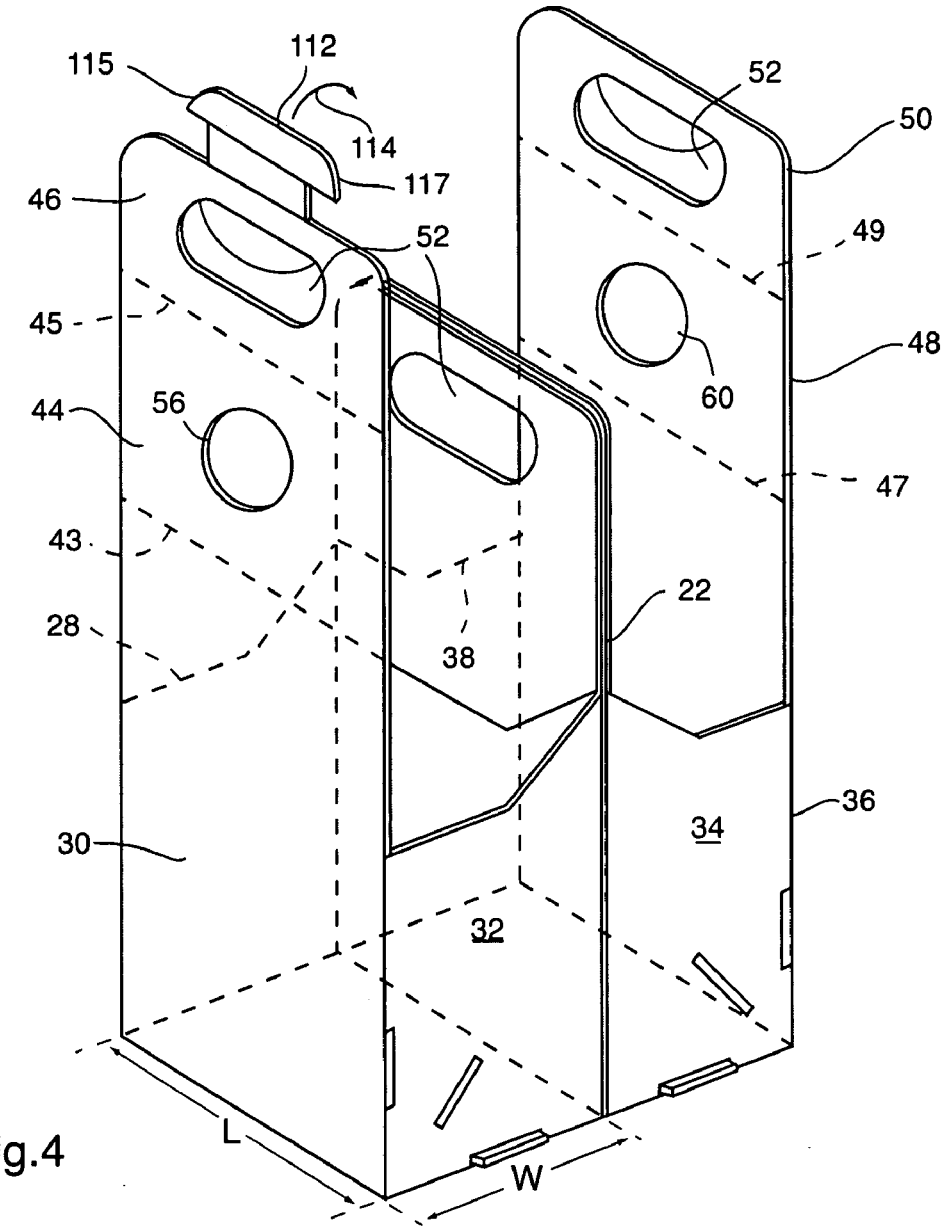
Fig.4

GLUE
FOLD
FOLD
FOLD
FOLD#4
GLUE
FOLD
FOLD
FOLD
FOLD

CARRIER AND METHOD

This patent application is a continuation-in-part of U.S. patent applications Ser. No. 10/215,938 filed Aug. 9, 2002, now U.S. Pat. No. 7,185,758; Ser. No. 10/662,265, filed Sep. 15, 2003, now U.S. Pat. No. 7,243,785; Ser. No. 10/737,612 filed on Dec. 16, 2003, now U.S. Pat. No. 7,267,224; Ser. No. 10/939,264 filed on Sep. 10, 2004 now U.S. Pat No. 7,604,115, Ser. No. 11/012,440 filed on Dec. 15, 2004 now U.S. Pat. No. 7,383,949, Ser. No. 11/012,789, filed Dec. 15, 2004, now U.S. Pat. No. 7,370,755; Ser. No. 11/301,913, filed Dec. 13, 2005 now U.S. Pat. No. 7,475,772, Ser. No. 11/301,407, filed Dec. 13, 2005 now U.S. Pat. No. 7,438,181, and Ser. No. 11/345,898, filed Feb. 2, 2006. The disclosure of those patents and patent applications are hereby incorporated herein by reference.

This invention relates to carriers for beverages, food, liquids in containers and other objects, and to methods of making and using such carriers.

Although the carriers of the foregoing patent applications are excellent for most purposes, it is desired to provide modified versions of those carriers which are able to carry and protect objects of diverse sizes and shapes and to form covers over the receptacles containing the objects to be carried.

In accordance with the invention, a carrier is provided in which outside walls are used to form handles and simultaneously cover all or a portion of the tops of the receptacles containing objects to be carried.

The covers can be provided with holes or slots through which the necks of bottles such as wine or beer bottles can protrude. This can provide valuable lateral support for tall objects to be carried, while partially covering upper surface portions of those objects.

Extra strength can be added to the handle structure by extending the central vertical panel structure upwardly and joining it with the extended outside walls to form a reinforced multi-ply handle structure.

Throughout its variations, the invention maintains the use of a pair of vertical support panels, a foldable receptacle extending outwardly from each panel, with the vertical support panels being secured together back-to-back, with each forming one side wall of one of the receptacles.

The preferred rectangular bottom structure for each receptacle is formed of four flanges, one extending downwardly from each of the four side walls of the receptacle. Each of two flanges is secured to an adjacent flange and the combination is folded diagonally at opposed corners of the rectangular structure. This bottom structure is strong and unfolds easily and automatically when the carrier is unfolded.

The bottom structure preferably has a wide flange and, optionally, a tab-and-slot detent structure to hold a partially-unfolded carrier open for filling.

As a result, carriers of the invention provide an economical covered or partially-covered carrier which is strong and relatively easy to fill, and is able to support beverage containers of a variety of sizes and shapes, especially tall necked containers.

The invention also provides an improved method for packaging items for carry-out from an alcoholic beverage store, grocery or convenience store, restaurant, sports arena concession stand, etc. Carriers of the invention of a single size, or of a small number of different sizes, can be used to better and more safely carry beverage containers of a wide variety of sizes and shapes. Thus, tall necked wine or beer bottles can be given good lateral support by the covers provided over the receptacles, with holes available to give lateral support for the necks of bottles to be carried.

Pre-packaged beverages in cans or bottles can be protected from dust and accidental spillage by means of the invention. The covers over the tops of the receptacles hold the beverage containers in the receptacles until the carrier cover is torn open. In the typical automatic carton filling equipment, the carrier is simply unfolded, filled with beverage containers, and the two outside walls are brought together and secured to one another. The carriers are selected so that the containers substantially fill the compartments in the carrier, and the outside walls are secured together so as to hold the containers together in a tight package.

The foregoing and other objects and advantages of the invention will be apparent from or set forth in the following description and drawings.

IN THE DRAWINGS

FIG. 4 is a perspective view of the carrier of FIG. 1 in an erected but unfilled state;

FIG. 17 is an enlarged, broken-away view of a component of the carrier of FIG. 1.

GENERAL DESCRIPTION

Figure 1:
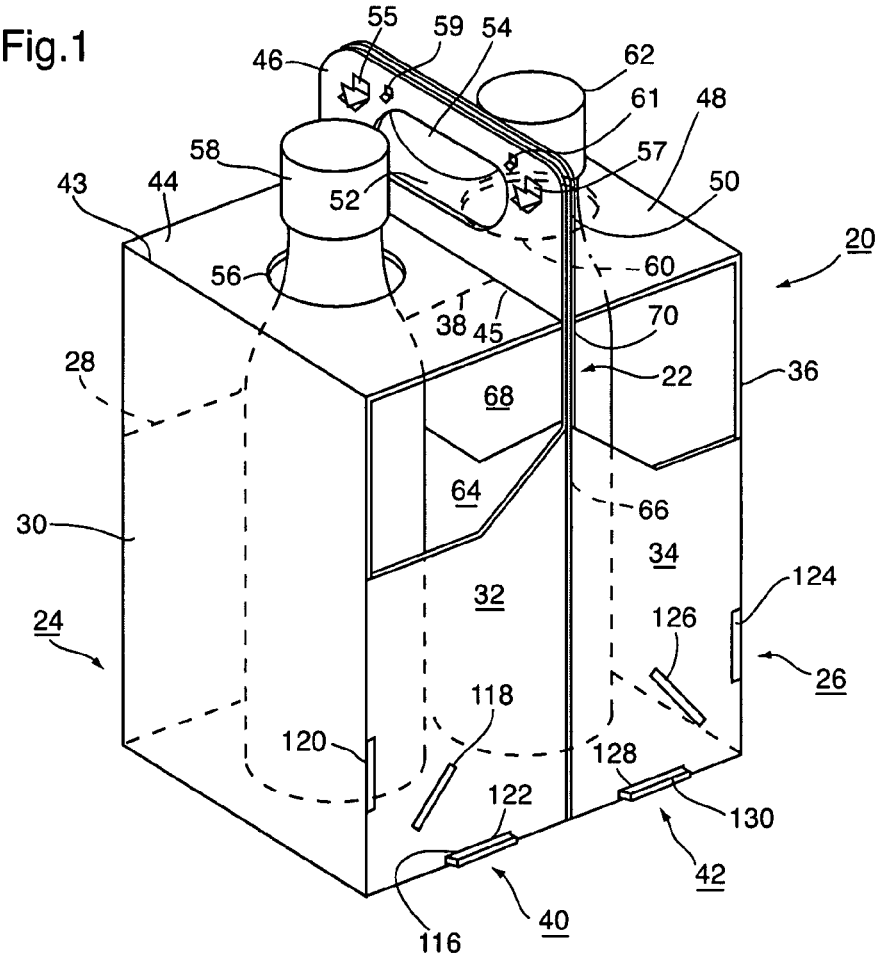
FIG. 1 is a perspective view of one embodiment of the carrier of the invention.

FIG. 1 is a perspective view of a carrier 20 constructed in accordance with the present invention. The carrier includes a vertical support panel structure 22 and, when unfolded, as shown in FIG. 1, includes two receptacles 24 and 26 which extend outwardly from opposite sides of the vertical support panel structure 22.

The first receptacle 24 includes a rear end wall 28, an outside wall 30, and a front end wall 32. One panel 64 forming the central vertical support panel structure 22 forms the fourth side wall of the receptacle 24.

Figure 5:
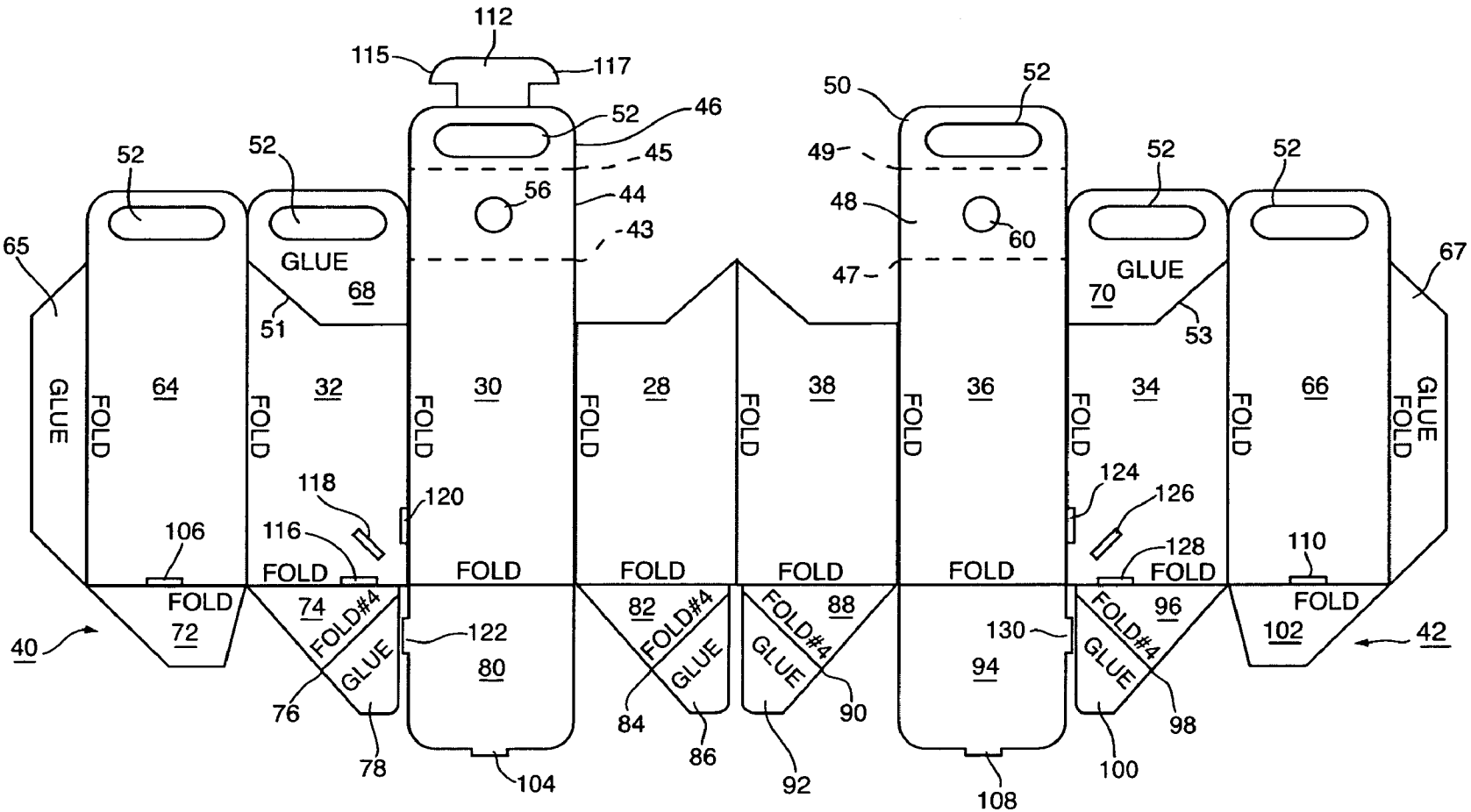
FIG. 5 is a top plan view of a blank used to make the carrier of FIG. 1.

Similarly, receptacle 26 includes a rear end wall 38, an outside wall 36, and a front end wall 34, as well as another panel 66 of the vertical support structure 22 (also see FIG. 5).

Each of the receptacles has a bottom structure 40 or 42 which is shown in greater detail in FIG. 5 and will be described below, and which has been described in some or all of the above-identified pending patent applications.

Each of the outside walls 30 and 36 is elongated so as to extend well above the upper edge of the two end walls 28 and 32 or 38 and 34.

The outside wall 30 has a section 44 foldable over along a fold line 43, and an upper edge section 46 formed by folding along another fold line 45.

Similarly, as shown in FIG. 5, the outside wall 36 has a section 48 defined by fold lines 47 and 49, and an upper edge section 50.

Each of the upper edge sections 46 and 50, as well as the upper edge sections of the panels making up the vertical panel structure 22 has a hand hole 52 with a hand guard 54. The hand holes 52 are aligned with one another and the upper edge sections are secured together so as to form a combined handle structure by means of which the carrier can be lifted and carried.

In accordance with one of the optional features of the invention, each of the panels 44 and 48 has a hole 56 or 60 positioned to receive the neck of a bottle 58 or 62 therethrough. This provides lateral support for the bottles near their upper ends so as to stabilize them and prevent them from falling from the receptacles in which they are carried.

As shown in FIG. 1, each of the bottles 58 or 62 has a diameter substantially smaller than the inside dimensions of the receptacle 24 or 26 in which it is located. This can come about when a carrier 20 of a standard size is used to package products which vary widely in size, as might be done in a carry-out retail store. By restraining the necks of the bottles by means of the panels 44 and 46 and the holes 56 and 60, etc., the carrier 20 can be used to carry a wide variety of bottles which might be too small to fit snugly in the carrier, or are tall with a tendency to tip, etc.

The carrier 20 has four locking structures 55, 57, 59, and 61 which are used to lock all of the parts of the handle structure together after the items to be carried have been loaded into the carrier.

FIG. 17 shows one of the four locking structures 57 in detail.

A rectangular hole 63 is die cut in all layers of the handle structure except one, in which an arrow-head shaped tab 69 is die-cut. The tab has two barbs 73 and 75 which project from the sides to a width somewhat wider than the width of the hole 63. The other three lock structures 55, 59, and 61 are of similar construction, except that the lock structures 59 and 61 are smaller than the structures 55 and 57. Material 71 only partially die cut is pushed outwardly when the tab 69 is pushed through the holes 63.

In locking the handle layers together, the layers are brought together with the holes 63, etc., aligned with one another and the tabs 69, etc., aligned with the holes, and the tabs are pushed through the holes until the barbs 73, 75, etc., catch on the side edges of the holes to lock the panels together. The tabs can be pushed through the holes by hand, or by the movement of rods, if the carriers are filled by automatic bottling equipment.

The handle layers can be pulled apart by hand fairly easily, when the customer wishes to open the carrier to remove a beverage container.

DETAILED DESCRIPTION

FIG. 5 is a plan view of the blank used to make the carrier 20, except that an alternative handle lock structure is used. Although a variety of different blanks can be used, the one shown in FIG. 5 is particularly well designed for fabrication using an automatic in-line gluing machine.

The blank includes a pair of panels 68 and 70 which are secured to the side walls 32 and 34, respectively, along weak perforated lines 51 and 53. During the gluing and folding process using automated equipment, the panels 68 and 70 are broken loose from the panels 32 and 34 and are folded over on the panels 64 and 66, respectively, and glued thereto in order to form a multi-ply handle structure.

Tabs 65 and 67 extend from the left and right edges of the blank and are glued and, when the panels are folded over, are attached, respectively, to the panels 38 and 28 to form the side walls of the receptacles 24 and 26.

The bottom structure 40 includes a first flange 72 which extends downwardly from panel 64, and a triangular flange 74, with a tab 78 and a diagonal fold line 76, extends downwardly from the panel 32. A broad panel 80 extends downwardly from the panel 30, and another triangular flange 82 with a tab 86 and diagonal fold line 84 extends downwardly from the panel 28.

Similarly, the bottom structure 42 for the receptacle 26 includes flanges 94 and 102, and triangular flanges 88, 96 with tabs 92, 100 and fold lines 90, 98 which are the mirror images of the corresponding flanges of the bottom structure 40.

Each of the broad flanges 80 and 94 has a tab 122 or 130 extending from one side and an end tab 104 or 108. The tab 122 or 130 cooperates with each of three slots 120, 118 and 116, or 124, 126, and 128, (also see FIG. 1) as the carrier is being unfolded to hold the receptacles open until objects have been placed in them. The placement of the objects in the receptacles presses the panels 80 and 94 downwardly until the tab 122 extends through the slot 116 and the tab 130 extends through the slot 128 to help hold the panel in a downward position. This feature of the invention is described in greater detail in some of the foregoing patent applications.

Glue is applied to the tabs 78, 86, 92, 100, 67, and 65, as well as to the surfaces of panels 68 and 70, and the panels are folded over upon one another to form the carrier structure which is folded and ready for shipment to a retail store, bottling facility or other place where it is loaded with items to be carried.

Still referring to FIG. 5, as well as FIG. 4, the locking structure includes a wide barbed male locking member or tab 112 extending from the upper edge of the panel 30. The tab 112 has two barbs 115, 117 extending to a width greater than that of the handle hole 52.

To lock the layers of the handle together, the panels are brought together with the holes 52 in alignment, and the tab 112 is folded over the upper edges of the panels, in the direction indicated by the arrow 114 in FIG. 4, and pushed through the holes 52 until the barbs 115, 117 are caught on the edges of the panel 46 to lock the panels together. This locking is easy to perform by hand, without any tools.

Other known locking structures can be used instead of those shown in FIGS. 1, 4, 5 and 17, if desired.

Alternative Bottle Neck Hole Shapes

Figure 2:
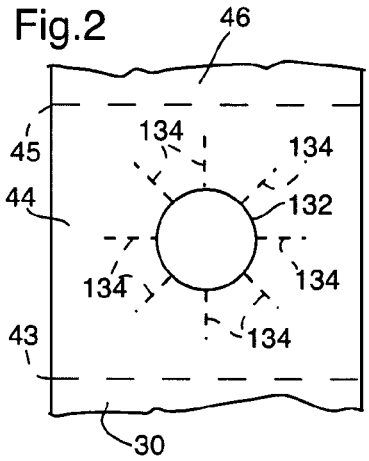
FIGS. 2 and 3 are broken-away plan views of alternative embodiments of the carrier of the invention.
Figure 3:
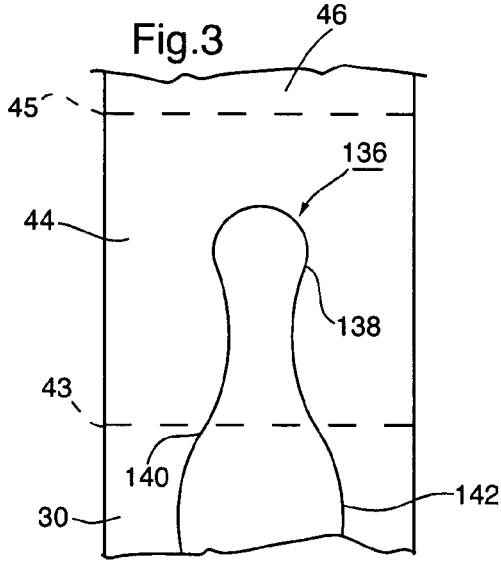

FIGS. 2 and 3 are broken away views of the panels 43 and 46 with alternative hole shapes which can be used to accommodate the necks of bottles of varying sizes.

The embodiment shown in FIG. 2 provides a circular hole 132 with radial perforations 134 extending outwardly from the edges of the hole. When a bottle neck of a diameter larger than the diameter of the hole 132 is thrust through the hole 132, the perforations 134 break and enlarge the hole to accommodate the larger bottle neck.

FIG. 3 is an elongated opening 136 with a generally wasp-like shape. It has an enlarged upper portion 138, a neck portion 140 and an enlarged lower portion 142. The elongated hole extends past the fold line 43 and downwardly into the panel 30. It is provided so that the panels 30 and 44 will be bendable to fit the contours of a larger bottle and give it added support. Openings of the shape shown in FIG. 3 are illustrated in some of the embodiments set forth hereinbelow.

FIG. 4 shows the unfolded carrier 20, with the alternative handle lock, in the position which the carrier takes prior to being loaded with objects to be carried. As it can be seen, the outside walls 30 and 36 with the extensions 44 and 46 and 48 and 50 make the panels extend well above the upper edge of the vertical support panel structure 22.

It should be understood that the dimensions of the various panels 44, 46 and 30 can be varied in order to accommodate different products to be carried. For example, the panels 44 and 48 are horizontal as shown in FIG. 1, and yet they need not be. Instead, they can be positioned at an angle as desired and needed. Also, holes of other shapes can be used to accommodate the bottle necks. The holes can be oval, rectilinear, or of any shape desired and suited to the purpose.

Further Alternative Embodiments

Figure 6:
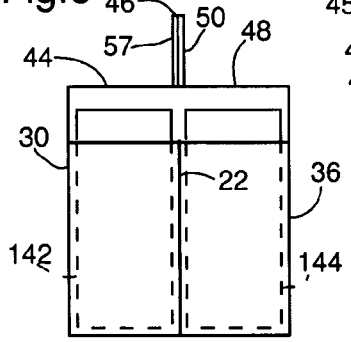
FIGS. 6, 7 and 8 are, respectively, end elevation, side elevation and top plan views of another embodiment of the invention.
Figure 7:
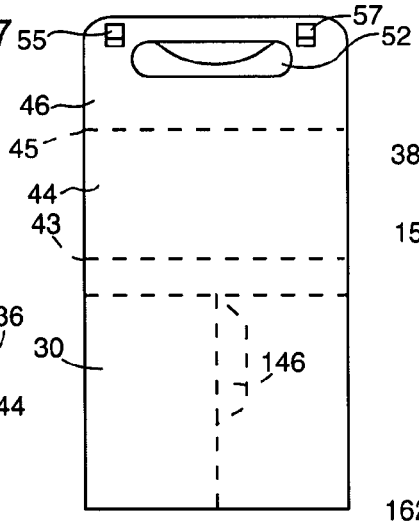
Figure 8:
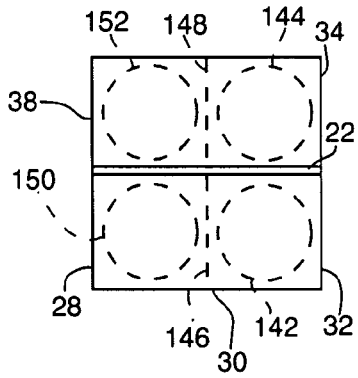

FIGS. 6, 7 and 8 show the carrier of FIG. 1 in use as a six-pack carrier for beverage cans 142 and 144. The panels 44 and 48, in this case, have no holes in them so that they completely cover the tops of the cans in the carrier.

As it is shown in FIGS. 7 and 8, dividers 146 and 148 are provided to divide the carrier into different compartments in which the cans are located. In the embodiment shown in FIGS. 6-8, there are four such compartments and a beverage can is located in each, as it is shown in FIG. 8, in which cans 150 and 152 are shown in addition to the cans 142 and 144. Of course, the carrier can be made to carry 6, 12 or other numbers of cans, as needed.

Figure 9:
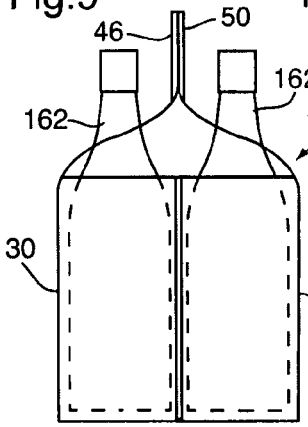
FIGS. 9 and 10 are, respectively, end and side elevation views of another embodiment of the invention.
Figure 10:
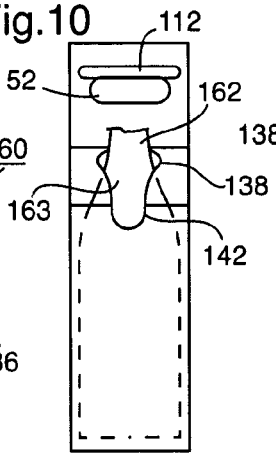

The carrier 160 shown in FIGS. 9 and 10 is especially desirable for packaging tall bottles such as wine bottles with long necks.

As it is shown in FIG. 10, the opening accommodating each of the bottle necks is of the type shown in FIG. 3 with an enlarged upper portion 138 and a lower portion 142. This is beneficial in gripping the bottle better and, also, in showing at least a portion of a label 163 of the bottle.

Figure 11:
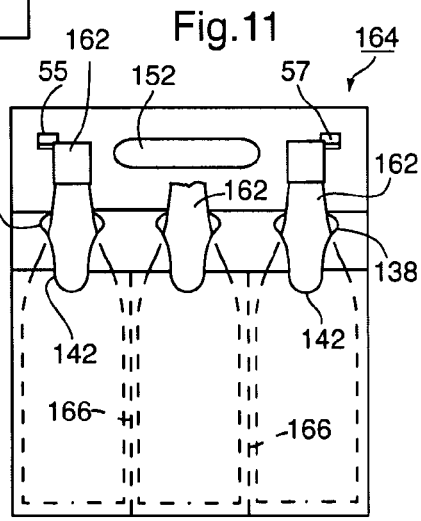
FIG. 11 is a side elevation view of another embodiment of the invention.

The carrier 164 shown in FIG. 11 is essentially the same as the carrier 160 shown in FIGS. 9 and 10, except that it is adapted to hold six tall wine bottles instead of only two.

Two dividers 166 are provided in each of the receptacles to provide six compartments, one for each of the wine bottles 162.

Figure 12:
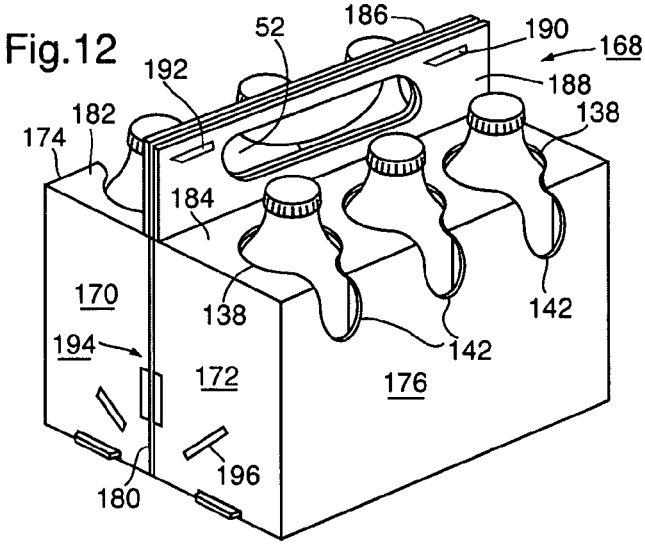
FIGS. 12 and 13 are, respectively, perspective and end elevation views of another embodiment of the invention.
Figure 13:
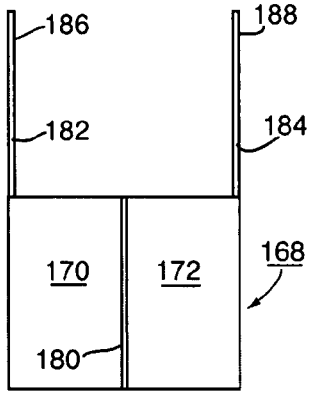

FIGS. 12 and 13 show another carrier 168 made in accordance with the invention. The carrier 168 is used to hold six small, short bottles of beer, sometimes called "nips". The carrier includes outside walls 174 and 176, end walls 170 and 172, horizontal cover portions 184 and 182, and vertical handle portions 186 and 188. Rear end walls are not visible in FIG. 12.

The vertical panels forming the two receptacles of the carrier are joined together as indicated at 180.

Locking structures 190 and 192 are provided in order to lock the various portions of the handle structure together after the bottles have been placed in the carrier.

As with the embodiments shown in FIGS. 9-11, the elongated hole structures shown in FIG. 3 are used. This allows the panels 182 and 184 to be drawn tightly towards the center of the structure so that the edges of the carrier tend to be rounded and the bottles are held tightly.

If desired, the panels 186 and 188 can be glued together during the packaging process rather than using the tabs 190 and 192.

Slot groups 194 and 196 are provided to aid in holding the receptacles open until loaded with bottles during the bottling procedure, as described above with respect to FIGS. 1 and 4.

FIG. 13 is an end view showing the carrier 168 as it looks immediately prior to loading the bottles into the receptacles.

All of the embodiments in FIGS. 6 through 13 have in common the feature that the vertical panel structure 22 or 180, etc., does not extend upwardly to be joined with the upper portions of the outside panels 30, 36, 174 and 176 to form a compound handle. This is because those carriers are designed to hold bottles or cans which are to be primarily prepackaged and delivered as six-packs, two-packs, four-packs, twelve-packs, etc., to grocery stores, alcoholic beverage stores, convenience stores, etc., for retail sale.

The compartments for the beverage containers are dimensioned so as to be only slightly larger than the containers they receive, so that the package can be made as tight as possible and so as to minimize the usage of materials. Moreover, the tight structure allows the further minimization of materials by shortening the central vertical panel structure and using only the upper extensions of the outside walls as handles.

It should be understood, of course, that the vertical central panel structure can be extended upwardly to join with the upper portions of the outside wall panels to give added strength, where needed.

Figure 14:
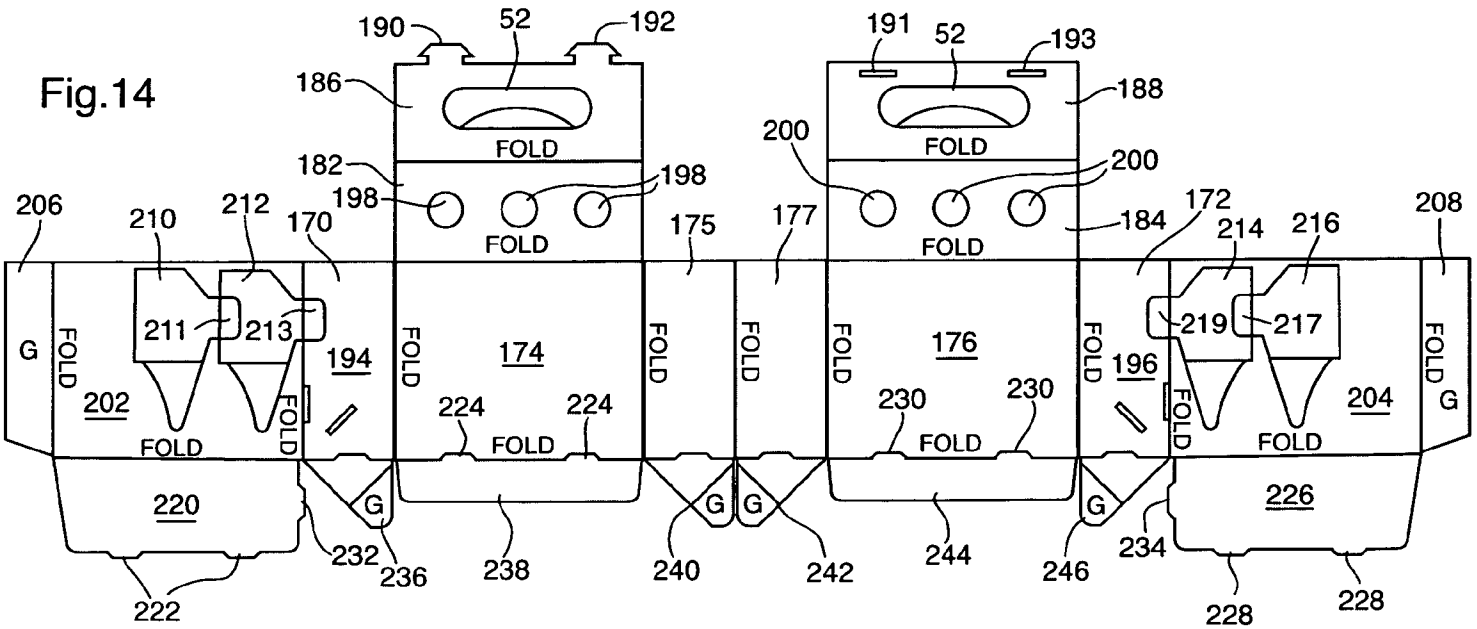
FIG. 14 is a top plan view of a blank for another embodiment of the invention.

FIG. 14 is a blank used to make a carrier which is almost the same as the carrier 168 shown in FIG. 12 except that it has six circular holes 198, 200 instead of the elongated holes shown in the FIG. 12 structure.

As with the FIG. 5 blank, the blank shown in FIG. 14 is designed for use with an in-line gluer.

The wall panels 170, 172, 174 and 176 are shown, as well as rear end panels 175 and 177 which are not visible in FIG. 12.

Vertical support panels 202 and 204 are shown, with flanges 206 and 208 extending from the left and right edges of the blank, as shown.

Four dividers 210, 212, 214 and 216 are shown. Each has a tab 211, 213, 217 or 219, respectively, which is glued to the opposing outside wall 174 or 176 in order to form the dividers, as described in greater detail in several of the above-identified patent applications.

Wide flanges 220 and 226 extend, respectively, from the lower edges of panels 202 and 204. Each wide flange has two tabs 222 or 228 which mate with slots 224 or 230 when the carrier is unfolded, so as to hold the flanges in place.

Side tabs 232 and 234 extend from the flanges 220 and 226. These cooperate with the locking slots 194, 196 to hold the receptacles open while they are being loaded with products. Narrower flanges 238 and 244 extend downwardly from the panels 174 and 176. Triangular panels of the type described above and shown in FIG. 5 are provided at 236, 240, 242 and 246. They function the same as those shown in the FIG. 5 structure to form automatically unfolding bottom structures when the carrier is unfolded.

The locking tabs 190 and 192 shown in FIG. 12 are shown in greater detail in FIG. 14. Each is a projection with two barbs extending outwardly at the sides. Each tab 190, 192 extends from the end of the panel 186.

Slots 191 and 193 are provided in the upper edge of the panel 188 in a position to receive the tabs 190, 192. When the panels 186 and 188 are brought together in order to fasten them to one another, tabs 190 and 192 are bent over and they are inserted through the slots 191 and 193 until he barbs catch. Thus, the tabs 190 operate to secure the two panels 186 and 188 together. Lock structures like the structures 55, 57 in FIG. 1 can be used instead, if desired.

Figure 16:
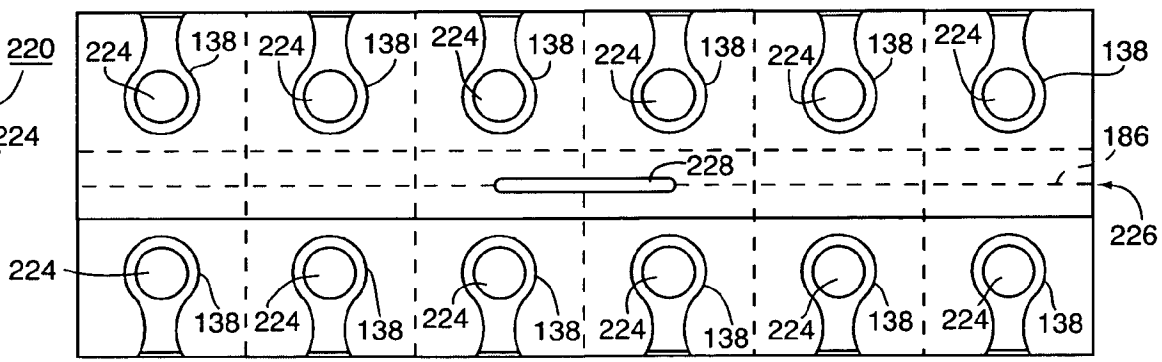
FIG. 16 is a top plan view of the carrier shown in FIG. 15.
Figure 15:
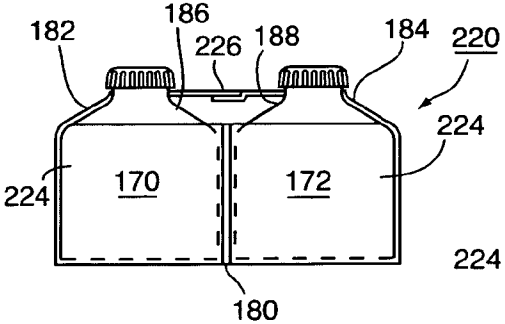
FIG. 15 is an end elevation view of a further embodiment of the invention.

FIGS. 15 and 16 show a further embodiment of the invention in which the carrier 220 has a flat top and a central slot 228 (FIG. 16) in the flat top to be used as a handle instead of an upstanding handle such as in the embodiments shown in the previous figures of the drawings. Again, stubby bottles of beer 224 are shown packaged in the carrier 220. The portions 182, 186, 184 and 188 are folded over to embrace the bottle tops, as in the FIGS. 12 and 13 embodiment, but, the upper portions 186 and 188 are not bent upwardly. Instead, they are overlapped and glued together along a seam 226 (see FIG. 16). This seam is formed after the bottles 224 have been loaded into the carrier. The panels 186 and 188 are pulled tightly towards one another and overlapped and glued together.

As it is shown in FIG. 16, the structure is used to form a twelve-pack. It also can be used to make a six-pack or a twenty-four-pack carrier, as needed and desired.

It should be understood that, in the blanks shown in FIGS. 5 and 14, areas to be glued are marked "GLUE" or "G", and fold lines are marked "FOLD".

The above description of the invention is intended to be illustrative and not limiting. Various changes or modifications in the embodiments described may occur to those skilled in the art. These can be made without departing from the spirit or scope of the invention.

What is claimed is:

1. A foldable carrier comprising (a) a pair of receptacles, each having four vertical side walls joined together along vertical fold lines to form a foldable enclosure, each of said side walls having lower edges, (b) each of said receptacles having its own foldable bottom structure, comprising four flanges, each secured to the lower edge of one of said four side walls along a fold line and being secured together so as to unfold to automatically form a multi-ply bottom structure when said side walls are unfolded, (c) said receptacles being secured together by an inner one of said side walls of one of said receptacles being secured to a corresponding inner one of said side walls of the other of said receptacles, (d) each of said receptacles having an outside one of said side walls opposite said inner side wall of said receptacle, (e) said outside wall having a height substantially greater than that of the side walls secured to it, (f) each of said outside walls being folded over towards said inner side wall in order to cover at least one of said receptacles when said carrier is unfolded, and having an upper edge with a handle structure near said upper edge, (g) said outside walls being secured together adjacent said upper edges.

2. A carrier as in claim 1 in which said inner side wall of each of said receptacles has a height substantially greater than that of the side walls attached to it and extends to adjacent said upper edges of said outside walls and is secured to said outside walls adjacent said upper edges.

3. A carrier as in claim 2 in which each of said inner side walls has a handle structure near its upper edge, each of said handle structures having a handle hole, said handle holes in said outside and inner side walls being aligned with one another to form a single handle structure.

4. A carrier as in claim 1 in which each of said outside walls has at least one opening for receiving the neck of a necked container therethrough when the container is positioned in the receptacle of which said outside wall is a part.

5. A carrier as in claim 4 in which each of said receptacles has at least one divider extending between said outside wall and said inner side wall, and each of said outside walls has a plurality of container neckreceiving holes.

6. A carrier as in claim 1 including a securing structure selected from the group consisting of (a) a set of mechanical locking elements; (b) said upper edges being overlapped and glued together to form a flat top with a handle slot, and (c) said upper edges being glued tougher to form a vertical handle structure.

7. A carrier as in claim 1 in which adjacent ones of said flanges at opposite corners of said bottom structure are secured together and foldable diagonally.

8. A carrier as in claim 4 in which said opening has a shape selected from the group consisting of circular, an opening with radial slits around the edge, an elongated slot, and an elongated hourglass shaped slot.

9. A carrier as in claim 1 including a fastening structure adjacent said upper edges of said outside walls comprising a lock tab projection on one of said outside walls, and a mating receptacle for said lock tab on the other of said outside walls.

10. A foldable carrier comprising (a) a pair of receptacles, each having four vertical side walls joined together along vertical fold lines to form a foldable enclosure, (b) each of said receptacles having its own foldable bottom structure, said bottom structure in each of said receptacles comprising a separate flange depending from the lower edge of each of said four side walls of said receptacle, said flanges being secured together so as to automatically unfold and form a bottom structure when said four side walls are unfolded, (c) said receptacles being secured together by an inner one of said side walls of one of said receptacles being secured to a corresponding inner one of said side walls of the other of said receptacles (d) each of said receptacles having an outside one of said side walls opposite said inner side wall of said receptacle, (e) said outside wall having a height substantially greater than that of the side walls secured to it, (f) each of said outside walls being folded over towards said inner side wall in order to cover at least one of said receptacles when said carrier is unfolded, and having an upper edge, each of said outside walls having a plurality of holes each of which is positioned to fit over the neck of a necked container in the receptacle below it, (g) said upper edges being overlapped and fastened together to form a flat top, said top having a handle slot in it.

11. A carrier as in claim 10 in which each receptacle has at least one divider with two ends, said divider being secured at one end to said outside wall of said receptacle and at its other end to said inner wall of said receptacle, thereby forming at least two compartments in said receptacle for holding a necked container therein with its neck extending through one of said holes.

12. A carrier as in claim 11 which each of said dividers is folded flat when said carrier is folded flat, but automatically moves into position to serve as a divider when said receptacle is unfolded.

13. A carrier as in claim 10 in which each of said receptacles is dimensioned to receive a specific size of necked container snugly.

14. A carrier as in claim 10 in which each of said holes is elongated in a direction perpendicular to said outside and inner side walls.

15. A carrier as in claim 10 in which said outside walls are pulled tightly against the shoulders of beverage containers in said receptacle.

16. A foldable carrier comprising (a) A pair of receptacles, each having four vertical side walls joined together along vertical fold lines to form a foldable enclosure, (b) Each of said receptacles having its own foldable bottom structure, said bottom structure in each of said receptacles comprising a separate flange depending from the lower edge of each of said four side walls of said receptacle, said flanges being secured together so as to automatically unfold and form a bottom structure when said four side walls are unfolded, (c) Said receptacles being secured together by an inner one of said side walls of one of said receptacles being secured to a corresponding inner one of said side walls of the other of said receptacles (d) Each of said receptacles having an outside one of said side walls opposite said inner side wall of said receptacle, (e) Said outside wall having a height substantially greater than that of the side walls secured to it, (f) Each of said outside walls being folded over towards said inner side wall in order to cover at least one of said receptacles when said carrier is unfolded, and having an upper edge, each of said outside walls having a plurality of holes each of which is positioned to fit over the neck of a necked container in the receptacle below it, (g) Said inner ones of said side walls having upper edges extending vertically to a height substantially greater than that of the ones of said side walls attached to said inner side walls, each having a handle structure adjacent said upper edge and aligned with the handle structure on the other of said inner ones of said side walls.

17. A carrier as in claim 16 in which each of said receptacles has at least one divider extending between said outside wall and said inner side wall.

18. A carrier as in claim 16 in which adjacent ones of said flanges at opposite corners of said bottom structure are secured together and foldable diagonally.

* * * * *